United States Patent [19]

Hewitt

[11] 4,067,676

[45] Jan. 10, 1978

[54] APPARATUS FOR EXTRUDING REINFORCED CONCRETE

[76] Inventor: Frederick M. Hewitt, 2913 N. Harrington, San Bernardino, Calif. 92402

[21] Appl. No.: 698,242

[22] Filed: June 21, 1976

Related U.S. Application Data

[60] Division of Ser. No. 534,263, Dec. 19, 1974, Pat. No. 3,994,639, which is a division of Ser. No. 322,811, Jan. 11, 1973, Pat. No. 3,926,541, which is a continuation-in-part of Ser. No. 50,491, June 29, 1970, abandoned.

[51] Int. Cl.[2] ..... B28B 1/08

[52] U.S. Cl. ..... 425/64; 404/100; 425/114; 425/432

[58] Field of Search ..... 425/59, 63–65, 425/219, 113–114, 123, 126; 404/100; 264/278

[56] References Cited

U.S. PATENT DOCUMENTS

| | | | |
|---|---|---|---|
| 2,209,726 | 7/1940 | Fleming | 425/114 |
| 3,334,559 | 8/1967 | Taylor | 404/100 |
| 3,468,001 | 9/1969 | Bodine, Jr. | 425/63 |
| 3,605,217 | 9/1971 | Martens et al. | 425/114 |

*Primary Examiner*—Francis S. Husar
*Assistant Examiner*—John McQuade
*Attorney, Agent, or Firm*—Nilsson, Robbins, Dalgarn, Berliner, Carson & Wurst

[57] ABSTRACT

Apparatus for forming concrete articles in which augers convey "no-slump" concrete mix to a molding station with sufficient force to consolidate the mix. Friction is reduced at form surfaces of the molding station by high frequency vibration, greater than 22,000 vibrations per minute. Core-forming mandrels are disposed axially lateral of the line of flight of the augers. The concrete can be prestressed utilizing pre-tensioning or post-tensioning mechanism and provision is made for transverse reinforcement of the concrete.

1 Claim, 23 Drawing Figures

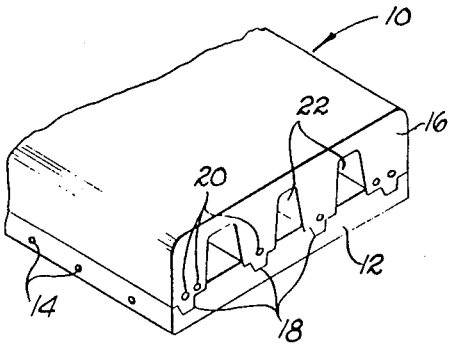
Fig. 1.
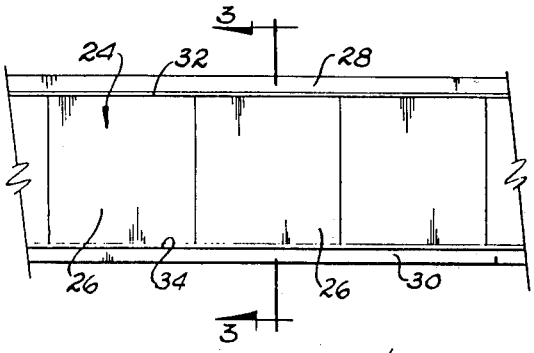
Fig. 2.
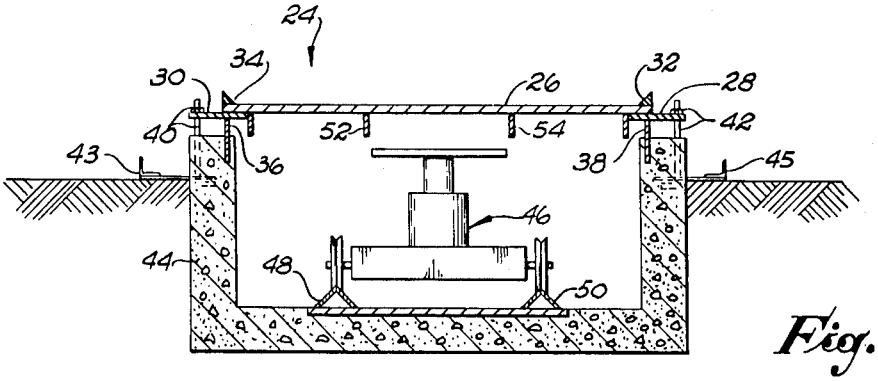
Fig. 3.
Fig. 4.
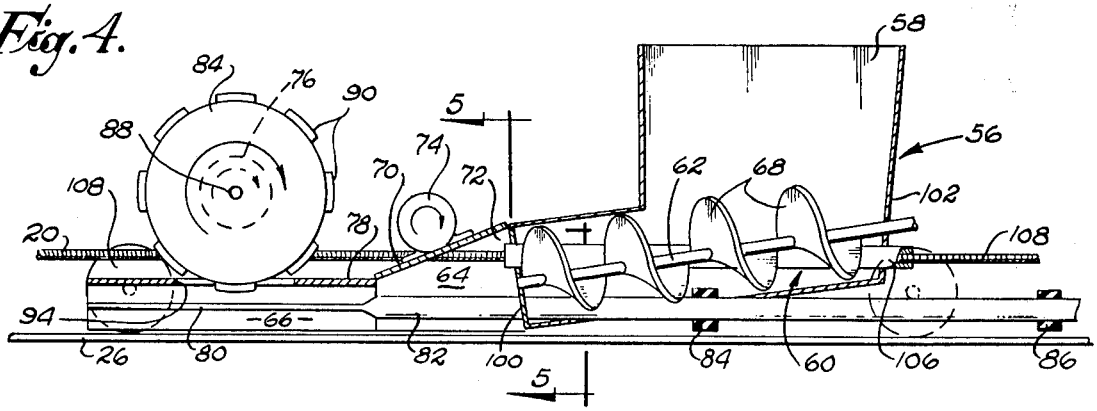
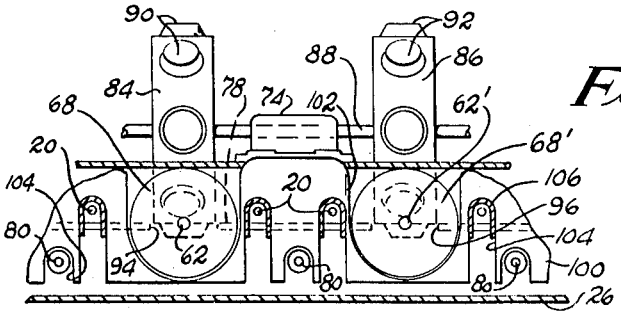
Fig. 5.

Fig. 6.
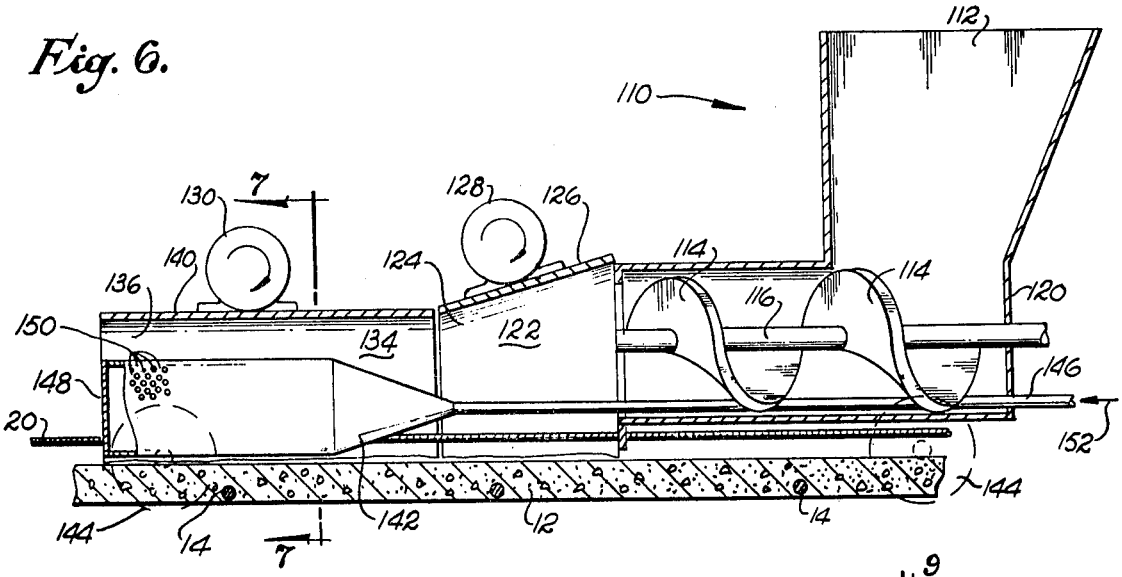
Fig. 7.
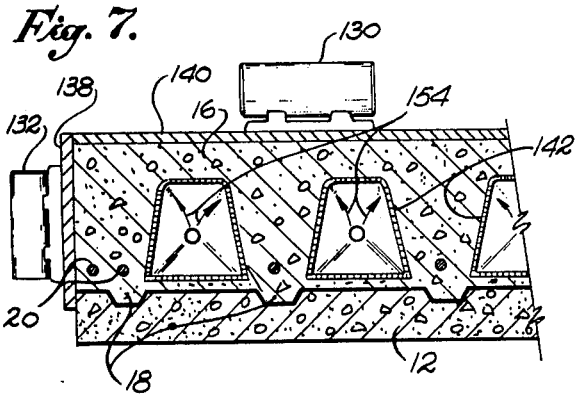
Fig. 8.
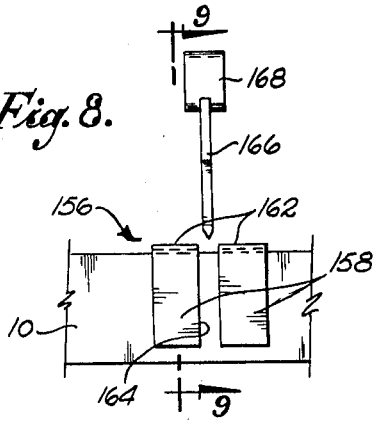
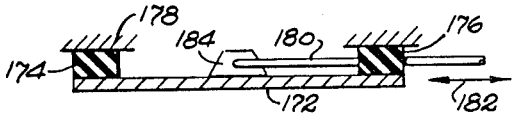
Fig. 10.
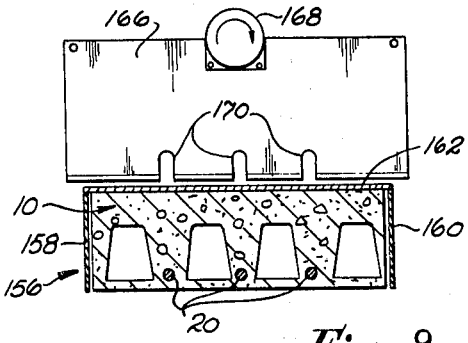
Fig. 9.
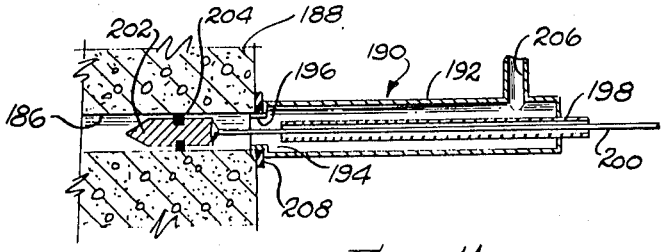
Fig. 11

Fig. 20.
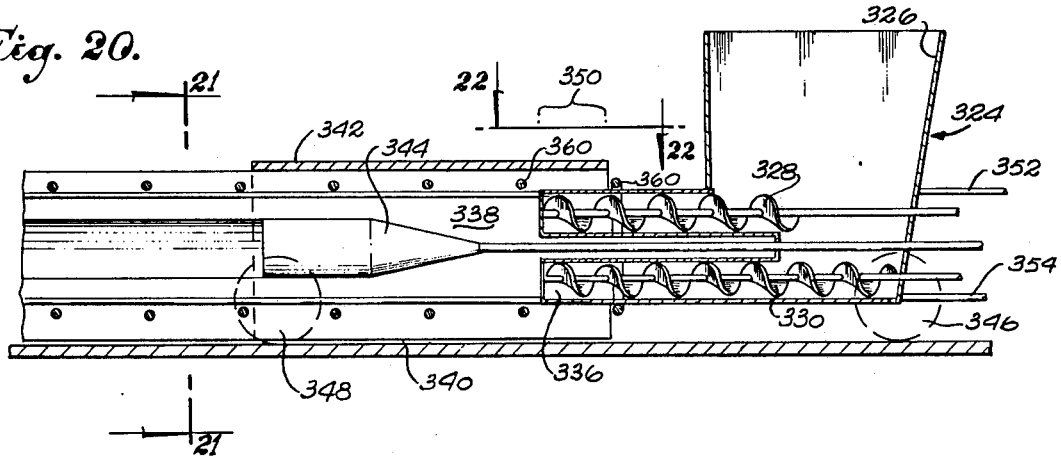
Fig. 22.
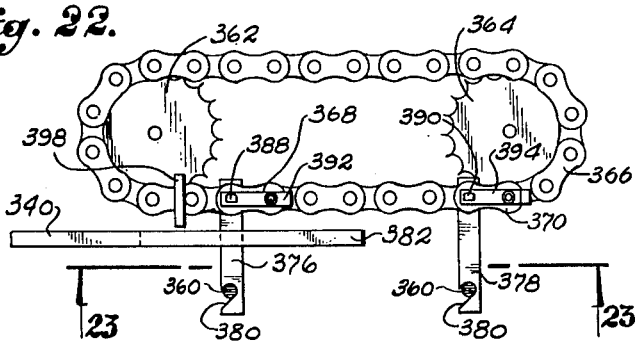
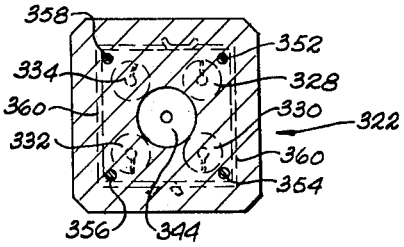
Fig. 21.
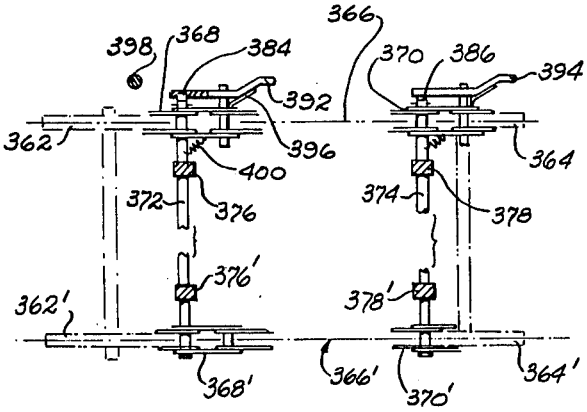
Fig. 23.

APPARATUS FOR EXTRUDING REINFORCED CONCRETE

This is a division of application Ser. No. 534,263, filed Dec. 19, 1974, now U.S. Pat. No. 3,994,639, which in turn is a division of application Ser. No. 322,811, filed Jan. 11, 1973, now U.S. Pat. No. 3,926,541, which in turn is a continuation-in-part of application Ser. No. 50,491, filed June 29, 1970, now abandoned.

FIELD OF THE INVENTION

The field of art to which the invention pertains includes the field of concrete extruding and molding apparatus.

BACKGROUND AND SUMMARY OF THE INVENTION

Various devices are used in slipforming concrete into beams, curbs, hollow core slabs, and the like, in which concrete is extruded on the "long line" principle. These devices are utilized to form a variety of articles from plain concrete, reinforced concrete and prestressed (both pre-tensioned and post-tensioned) concrete. In the production of long slabs, concrete is precast with hollow cores on long beds or pallets, usually without transverse reinforcement. If transverse reinforcement is necessary when assembling floors or other slabs, to provide seismic "diaphragm" or for any other reason, then it is provided by either pouring a reinforced concrete topping over the slabs, when in place, or by welding or otherwise connecting projecting steel in the joints. Neither of these methods is very satisfactory and each is very expensive requiring large amounts of manual labor. It would be better to post-tension the slabs in place but the usual method of extrusion does not provide this ability.

Exemplary of modern extrusion techniques are the methods and apparatus described in U.S. Pat. Nos. 3,049,787, 3,159,897 and 3,284,687. These methods involve feeding concrete mix to one or more augers which force the mix into a molding section and out past a troweling section. The augers terminate in a mandrel which, by turning with the augers, shapes and forms hollow cores. The forming surfaces of the molding section are subjected to high amplitude vibration, at about 9–12,000 vibrations per minute, so as to compact and consolidate the concrete about the auger-driven mandrels. A disadvantage of such an "auger-mandrel" system is that the hollow cores are formed circular and must be located in the lines of flight of the augers.

The present invention provides slipforming apparatus which overcomes the foregoing deficiencies. The present invention utilizes the compacting force of rotating augers to consolidate "no-slump" concrete between form surfaces at a molding station and utilizes vibrations applied at the molding station. However, the vibrations are not utilized primarily to compress the cement mix, but rather to reduce friction at the form surfaces. Accordingly, whereas the prior art utilizes high amplitude, relatively low frequency vibrations, the present invention utilizes high frequency vibrations, in excess of 22,000 vibrations per minute, of relatively low amplitude. In another embodiment of the invention, friction is reduced by directing fluid, such as air or steam, under pressure between the form surfaces and the concrete mix. In contrast to prior methods, the present mode of operation enables the use of stationary mandrels which need not be located in the lines of flight of the augers and, in fact, are disposed axially lateral of such lines of flight. The result is that concrete articles can be formed with hollow cores of any desired configuration and placement.

Prestressed articles can be produced either for pre-tensioning or for post-tensioning. For post-tensioning, an elongate bar can be disposed in the extrusion path and the concrete mix consolidated thereabout so that as the bar is withdrawn, an elongate opening is defined through the extruded mix. The bar can be vibrated and, in this regard, consolidation of the concrete mix about the bar exerts a tensioning force which harmonically increases the vibrational frequency, thereby aiding in overcoming frictional forces. After the post-tensioning openings are formed, a prestressing strand can be threaded through the opening and tensioned. For this purpose, a novel air gun is provided which projects a leadwire through the opening.

For pre-tensioning, cables can be tensioned along the extrusion path and the concrete extruded thereabout. In this regard, prior sawing methods could not be used with prestressed "green" concrete since they require sawing through the prestressing strands in order to cut the article to a desired length. However, in accordance with the present invention, desired lengths of the article are obtained by introducing a plate into the extruded "green" mix transverse to the path of extrusion and vibrating the plate at a high frequency so as to reduce friction between the plate and the extruded mix. The vibrating plate is formed with cutouts for the prestressing cables so that the cables need not be cut at that point but can wait until the line has been completely formed and the concrete cured.

The present methods can be utilized to obtain transversely tensioned concrete articles. In this regard, a square slab of prestressed concrete can be extruded, the process stopped and the slab rotated so as to be positioned normal to the prior extrusion path. A second prestressed layer can then be deposited on the surface of the first slab to provide transverse reinforcement. Prior to extrusion of the second slab, a shear key is indented into the top surface of the first extruded slab, the second extrusion filling the indentations to securely and integrally form the article.

In still further embodiments, transverse reinforcement can be introduced into the concrete mix at the initial region of the molding station. In this regard, an overlap region can be formed between the auger flights and the form surfaces of the molding station, and U-shaped transverse ties (or other shapes where suitable) inserted at that point. Guide bars move the ties at extrusion speed through at least a consolidation region of the molding station.

The conveyors and molding station are movably mounted either with respect to a pallet or with respect to the ground so that as concrete is extruded, the apparatus moves in reaction therefrom. In the event that concrete is extruded directly on to a ground surface, such as when laying a median barrier strip on a highway, leveling mechanisms are utilized to maintain a uniform height and pitch.

BRIEF DESCRIPTION OF THE DRAWINGS

FIG. 1 is an isometric view of a hollow core concrete slab capable of being transversely reinforced;

FIG. 2 is a schematic plan view of a line of pallets to carry slabs formed in accordance with this invention;

FIG. 3 is a schematic, cross-sectional view on line 3—3 of FIG. 2 in the direction of the arrows;

FIG. 4 is a schematic, longitudinal-sectional view of one type of extruder of this invention;

FIG. 5 is a cross-sectional view on line 5—5 of FIG. 4, in the direction of the arrows;

FIG. 6 is a schematic, longitudinal-sectional view of another type of extruder utilized herein;

FIG. 7 is a schematic, cross-sectional view on line 7—7 of FIG. 6 in the direction of the arrows;

FIG. 8 is a schematic, elevational view of end forming apparatus;

FIG. 9 is a cross-sectional view on line 9—9 of FIG. 8, in the direction of the arrows;

FIG. 10 is a schematic illustration of one form of vibration system;

FIG. 11 is a schematic, longitudinal-sectional view of post-tensioning apparatus of this invention;

FIG. 20 is a longitudinal-sectional view of another type of an extrusion apparatus utilized herein;

FIG. 21 is a cross-sectional view on line 21—21 of FIG. 20, in the direction of the arrows;

FIG. 22 is a schematic, partially cross-sectional, partially plan view on line 22—22 of FIG. 20, in the direction of the arrows; and FIG. 23 is a schematic view on line 23—23 of FIG. 22, in the direction of the arrows.

DETAILED DESCRIPTION

Figure 12:
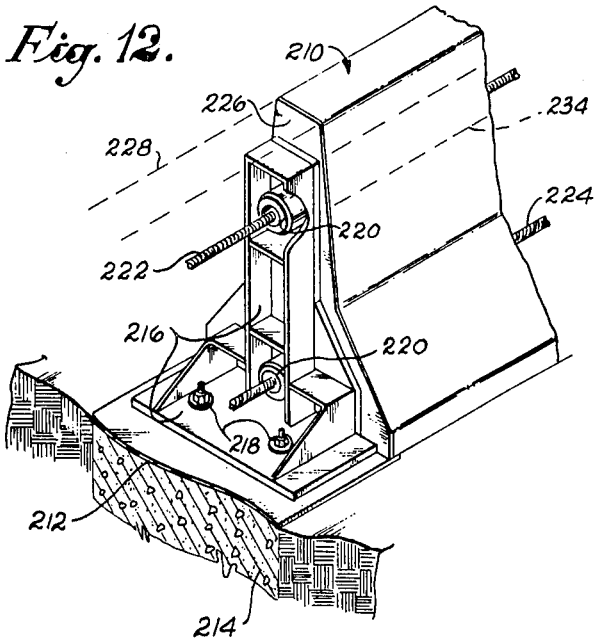
FIG. 12 is an isometric view of the anchored end of a prestressed concrete median barrier constructed in accordance with the present invention.

As required, detailed illustrative embodiments of the invention are disclosed herein. However, it is to be understood that these embodiments merely exemplify the invention which may take many different forms that are radically different from the specific illustrative embodiments disclosed. Therefore, specific structural and functional details are not to be interpreted as limiting, but merely as a basis for the claims which define the scope of the invention. In accordance with the foregoing, three forms of extruded concrete articles are illustrated. One form exemplified by FIGS. 1–9 is directed to the production of flat slabs. The embodiment exemplified by FIGS. 12–19 is directed toward the production of a concrete median barrier. The embodiment exemplified by FIGS. 20–23 is directed to the production of elongate piles. In each case, the concrete article produced is formed with one or more hollow cores and can be prestressed. In addition to the foregoing, the embodiments illustrated by FIGS. 10 and 11 are particular devices useful in the practice of each of the embodiments herein.

Of central importance to the construction of each of the embodiments is the interoperative relationship of two principles: (1) compaction by means of augers or other such conveyor whereby to consolidate a free-standing or "no-slump" concrete mix within a molding station, and (2) reduction of friction by the application of high frequency vibration.

Referring now to the embodiment of FIGS 1–9, including reference also to FIGS. 10 and 11, and particularly with respect to FIG. 1, there is illustrated a double-extruded slab 10 of prestressed, transversely reinforced, hollow-cored concrete. A first stage slab section 12 is formed with cable holes 14 in one direction and supports a second stage slab section 16, secured in shear keys 18. The second stage slab section 16 is formed with prestressing cables 20 disposed normal to the direction of the lower prestressing cable holes 14. Additionally, the second stage slab section 16 is formed with a plurality of hollow cores 22 of truncated isosceles triangle cross-section.

The first stage slab section 12 is extruded on a pallet 24 shown schematically in FIG. 2 and in cross-section in FIG. 3. The pallet 24 is formed in a long line (for example 400–600 feet) and is segmented into separate square sections 26, for example 4 feet × 4 feet. Rails 32 and 34 on opposite sides of the pallet may be used to provide fillets on the slab bottom edges if desired.

Referring to FIG. 3, pallet supports 28 and 30 are carried by plates 36 and 38 and controlled by leveling rods and nuts 40 and 42 on a concrete bed 44. Tracks 43 and 45 are formed on opposite sides of the bed 44. A mobile jack 46 runs on rails 48 and 50 beneath the pallet and can be raised against any pallet section 26, secured between flanges 52 and 54 dependent therefrom. When it is desired to raise a particular pallet section 26, the mobile jack 46 is run beneath the pallet 24 and raised whereupon it engages the under side of the pallet section 26 between the securing flanges 52 and 54. The jack 46 is designed to rotate 90° so that a particular slab section 12 formed thereon may be turned normal to the path of extrusion, as hereinafter detailed.

Referring to FIG. 4, there is disclosed one form of extruder 56 embodying the interoperative principles of the present invention. In general terms, the extruder 56 includes a feed section in the form of a hopper 58, a conveyor section 60, which includes a plurality of augers 62, a consolidation section 64 and a molding or extrusion die section 66. In this particular embodiment, two augers 62 and 62′ (FIG. 5) are utilized, but a greater number may be used, or only a single auger may be used.

Concrete mix (not shown) of the "self-standing" or "no-slump" type is introduced into the hopper 58 whereupon it falls into the auger flights 68. A motor (not shown) drives the auger 62 so that the flights 68 carry the concrete into the consolidation section 64. The consolidation section 64 is defined by a top wall 70 and side walls such as 72 which conically decrease the volume of the consolidation section 64 toward the molding section 66. The auger flights 68 force the concrete mix through the consolidation section 64 and into the molding section 66.

In accordance with the present invention, simultaneously with compaction of the concrete mix by means of the forceful drive of the augers 62 and 62′, vibration is applied to the surfaces of the consolidation and molding sections 64 and 66 which are in contact with the concrete mix. Vibration assemblies for such purpose are schematically shown at 74 and 76 in FIG. 4. Such vibrators can be pneumatically driven so as to rotate an eccentric in the direction shown, i.e., in the direction of extrusion. A vibration assembly should be located on each of the walls in contact with the consolidated mix, although representation thereof will be omitted from some of the figures for clarity of illustration.

Importantly, the frequency of vibration is much higher than heretofore utilized. In prior devices, vibration was utilized for compaction purposes to directly aid in consolidating the concrete mix particles. In such cases, frequencies on the order of 7,000 to 12,000 vibrations per minute were utilized with high amplitudes. In the present invention, much higher frequencies are utilized and the amplitude can be quite low. In accordance herewith, high frequency vibration up to the ultrasonic range, in excess of 22,000 vibrations per minute, and up to 50,000 vibrations per minute, or higher, should be utilized. The high frequency vibrations serve a purpose which is quite different from the effect of vibrations of low frequency as utilized in prior devices, the present purpose being to reduce friction rather than to aid in compaction. While the very high frequencies utilized herein provide less friction between the surfaces of concrete mix particles thereby enabling greater compaction, the major purpose is to reduce friction between the concrete mix and the form surfaces in contact with the mix, such as the walls of the consolidation and the molding sections 64 and 66. To facilitate the transmittal of such vibration, the consolidation and molding section walls, such as 70 and 72, are slidably secured to a supporting frame (not shown) so as to move forwardly and rearwardly in their planes.

In terms of exemplary dimensions, the first stage slab 12 is formed about 3 inches thick. A plurality of bars 80 about ½ inch in diameter, are disposed lengthwise through the molding section 66 and are formed with thicker portions 82 rearwardly thereof, which thicker portions are supported on rubber mounts 84 and 86. Vibrators (not shown) are mounted on the bars 80 rearwardly of the mounts 84 and 86 whereby to vibrate the bars 80. When concrete mix is consolidated about the bars 80, it exerts tensioning forces thereon thus harmonically increasing the vibration frequency when there is most resistance to movement and therefore a greater need for high frequency vibration to reduce friction. By means of the bars 80, post-tensioning holes are formed in the lower slab section 12 through which prestressing cables 14 can be threaded.

Referring to FIG. 5 in conjunction with FIG. 4, a pair of imprint wheels 84 and 86 are journaled on a common axle 88 which is rotatably supported on the framework (not shown) of the device. The imprint wheels 84 and 86 are formed circumferentially with circular punches 90 and 92 which rotate into contact with the top surface of the first stage slab section 12 as it is being extruded, through openings 94 and 96 in the wall 78, to thereby punch a plurality of shear keys 18, referred to above, approximately ¾ inch deep and 3 inches in diameter. Vibration assemblies 76, as indicated by the dashed lines in FIG. 4, are secured within each imprint wheel 84 and 86.

In this particular embodiment, pre-tensioned cable 20 is to be used for prestressing the second stage slab section 16. Accordingly, provision must be made in the extruder 56 for clearance of these cables 20, and the manner in which this is accomplished is illustrated in FIG. 5. The forward end of the conveyor section is formed with a forward bulkhead 100 which has portions 102 cutaway in axial alignment and coincidence with the diameter of the auger flights 68 and 68'. Notches 104 are formed upwardly from the bottom surface of the forward bulkhead 100 to admit the bars 80 and cables 20. Additionally, aprons 106 are supported between the forward bulkhead 100 and a rear bulkhead 102 (FIG. 4), protecting the cables 20 from lateral displacement as a result of the rotational movement of the auger flights 68.

The frame (not shown) carrying the components of the extruder 56 is supported on front and rear wheels 108 which are positioned in tracks 43 and 45. Referring back to FIG. 3, after the first stage slab section 12 has been extruded to the extent of one pallet section 26, it is cut utilizing a vibrating plate as will hereinafter be described, or by sawing as known to the prior art so as to form a square slab section. The mobile jack 46 is positioned beneath the pallet 26, is raised to engage the pallet, turned 90° and lowered so as to replace the first stage slab section 12 normal to the extrusion path. This positions the holes 14 so that post-tensioning strands can be threaded transversely through a slab assembly.

Referring now to FIG. 6, after a series of first stage slab sections 12 have been turned 90°, the upper slab section 16 is extruded thereon. An extruder 110 is utilized which is similar in function to the extruder 56 of FIG. 4 but which is dimensioned so as to extrude a relatively thicker slab section 16, up to 10 or 12 inches thick. The extruder 110 includes a hopper 112 through which "no-slump" concrete mix is introduced to the flights 114 of an auger 116 supported between a bulkhead 120 and a rearward bearing (not shown). The auger flights 114 carry the concrete mix into a consolidation section 122 defined by side walls 124 and a top wall 126, each wall carrying a vibration assembly such as illustrated at 128, 130 and 132 (FIG. 7) and are of the type previously described, i.e. generating high frequency vibrations. The consolidated concrete mix is then extruded into the molding section 134 defined by side walls 136 and 138 (FIG. 7) and a top wall 140. The molding section 134 contains core-forming mandrels 142 as will hereinafter be described in more detail.

The processes hereinabove described were referred to as extrusions, but they may be more accurately described as retrusions. Concrete mix is not expelled from the molding section 134, but rather the molding section 134 and other components of the extruder 110 as carried on its framework (not shown) is moved rearwardly in reaction to the compaction and consolidation of the concrete mix particles, and for this purpose the framework is provided with a set of wheels as indicated in dashed lines at 144. This manner of retrusion is well known as described in the aforenoted U.S. Patents.

Referring to FIG. 7 in conjunction with FIG. 6, the core formers 142 are shaped as desired and are formed rearwardly with hollow pipes 146. High frequency vibrators can be placed internally of the core formers 142 or the pipe 146 can be vibrated along its longitudinal axis. However, in this particular embodiment, vibration of the core formers is accomplished with fluid pressure. The core formers 142 are formed with walls 148 (FIG. 6) closing the front ends thereof and the side walls are formed with a large number of small apertures as partially indicated schematically at 150 in FIG. 6. Fluid in the form of air or steam under pressure is introduced through the pipe 146, as indicated by the arrow 152 in FIG. 6 and by the arrows 154 in FIG. 7. The purpose of the fluid under pressure is to "liquidize" the cement mix particles adjacent the surface of the core formers 142 whereby to reduce friction. In this regard, steam under pressure is more effective, but pressurized air is satisfactory with many operations.

Referring particularly to FIG. 7, it will be seen that the concrete mix is consolidated about pre-tensioned cables 20 and is forced into the shear keys 18. If necessary, the first stage slab section 12 can be sprayed with water, or with epoxy solution if it has cured too long, prior to extrusion thereon of the second stage slab section 16.

The second stage slab section 16 can be extruded in long line fashion without regard to sectioning as required for the first stage slab sections 12, and can be cut to any desired length. Referring to FIGS. 8 and 9, there is illustrated one method for cutting desired lengths, and simultaneously providing smooth formed ends. As soon as possible after extrusion, while the concrete 10 is still "green" a guiding frame 156, on a supporting carriage (not shown), is run into place. The frame 156 includes side walls 158 and 160 and a top wall 162 defining a slot 164 therethrough for guiding a cutting plate 166. The cutting plate 166 carries a high frequency vibration assembly 168 which provides vibrations in the plane of the plate 166. The plate 166 is formed with slots 170 extending from its bottom edge to accommodate the prestressing cables 20 and is inserted while vibrating into the "green" concrete slab. By such means, the slab is divided as desired, without cutting the cables 20. The cables 20 can be severed after the concrete has cured. Although a single end-forming plate 166 has been illustrated, a plurality of plates can be utilized in place of the single plate.

Referring now to FIG. 10, there is illustrated one manner of imparting vibration to a wall 172 as may be located on a consolidation or molding section of an extruder. The wall 172 in the present illustration is supported by rubber mounts 174 and 176 on a frame 178. A rod 180 is connected to a vibration source so as to vibrate laterally with respect to the wall 172, in the direction of the arrow 182, and is connected by a mount 184 exteriorly to the wall 172.

In place of pre-tensioned cable 20, the second stage slab 16 can be formed with longitudinal openings therethrough in the manner depicated with respect to the extrusion of the first stage slab section 12. In view of the relatively long uninterrupted length of the second stage slab section 16, a method would be needed for threading a post-tensioning cable through such an opening. Apparatus to accomplish such threading is depicted in FIG. 11. There is depicted an elongate opening 186 defined through a section of consolidated concrete 188. The threading device is an air gun 190 which includes a housing 192 defining an air chamber 194 and formed with an air escape opening 196 at the forward end thereof. A cable support tube 198 extends within the housing 192 and a close fitting leadwire 200 is threaded through the support tube 198. The forward end of the leadwire 200 is connected to a projectile 202 which is formed with a "Teflon" washer 204 close-fit in the opening 186. An air pressure inlet 206 is formed into the housing. A rubber gasket 208 is disposed around the air escape opening 196 so that the air gun 190 can be placed firmly against the concrete material adjacent the opening 186. In operation, the air gun is positioned with the air escape opening 196 in communication with the opening 186, with the projectile 202 in the opening connected to the leadwire 200 which, in turn, is threaded through the housing 192. Air pressure is applied to the inlet 206 whereupon the projectile is forced through the opening 186 carrying the leadwire 200.

Figure 13:
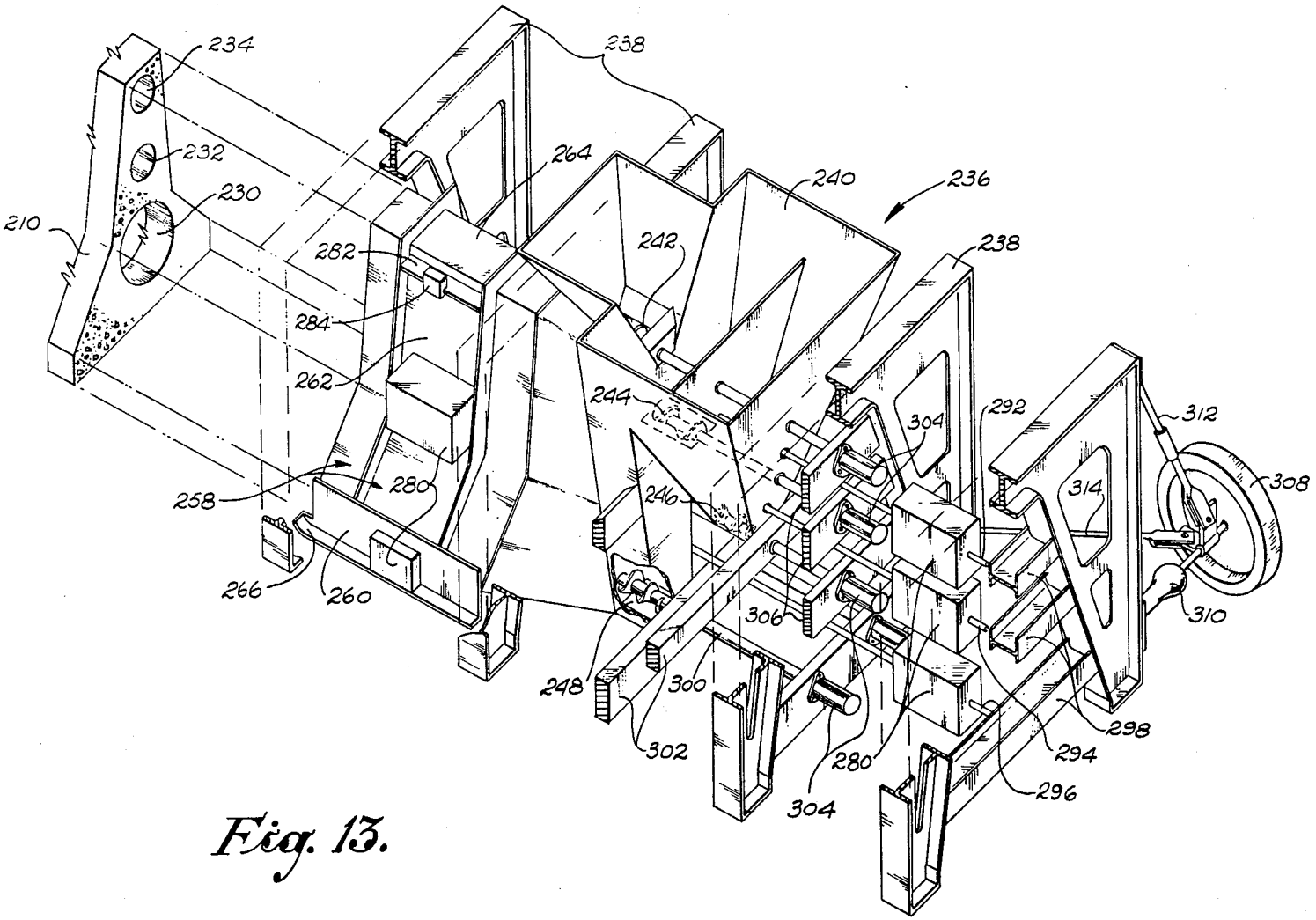
FIG. 13 is an isometric, partially cut away, schematic view of apparatus for forming the barrier of FIG. 12.

Referring now to the embodiment depicted in FIGS. 12–19, and more specifically to FIG. 12, there is illustrated a concrete medial barrier 210 such as is utilized to separate lanes of traffic on roadways. The barrier 210 is extruded in place on the roadway, as will hereinafter be described. In FIG. 12, only the end section of the barrier is shown wherein it is anchored in place on a neoprene pad 212 to a concrete bed 214 laid at the end section only. An anchorage plate 216 is secured to the concrete bed 214 by means of anchor bolts 218. An upward extension of the anchor plate 216 is secured to the median barrier 210 by means of cable anchors 220 fixed to post-tensioning cables 222 and 224 so as to sandwich a bulkhead 226 against the end of the median barrier 210. An anchorage cover, indicated by dashed lines at 228, is removably secured to the bulkhead 226 and anchor plate 216 by means not shown. The anchorage cover is sufficiently strong to withstand vehicle impact and extends a short distance between anchored ends, eg., about 4 feet. Referring additionally to FIG. 13, the median barrier 210 is formed with a plurality of cores 230, 232 and 234, one on top of the other and the post-tensioning cable 222 and 224 are threaded through the end cores 230 and 234. The center core 232 can be used as a utility duct if desired.

Referring to FIG. 13 in more detail, a median barrier extruder 236 is schematically illustrated. The components are supported on upright interconnected frame members indicated at 238 and include a hopper 240 which supplies concrete mix to five auger flights 242, 244, 246, 248 and 250 (FIG. 15) spaced so that, in conjunction with a distributive shaping of the hopper 240, concrete mix is substantially evenly distributed.

Figure 14:
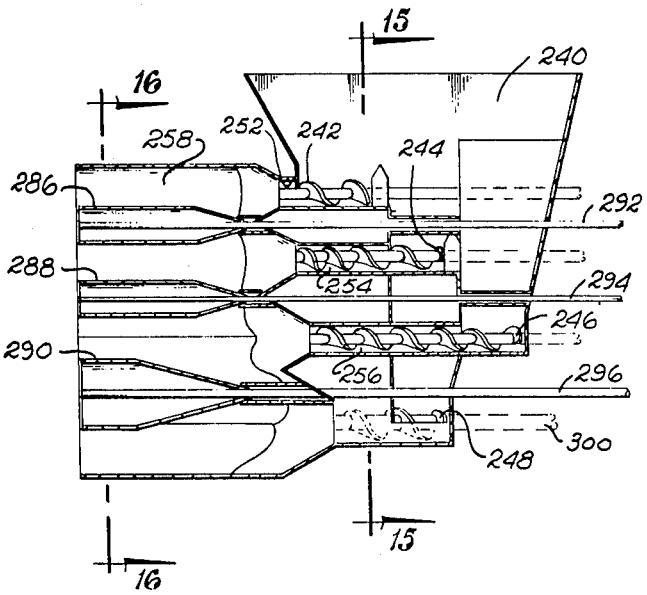
FIG. 14 is a longitudinal-sectional view depicting the auger and core forming mandrels utilized in the apparatus of FIG. 13.
Figure 15:
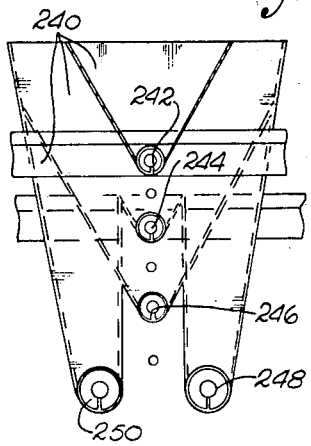
FIG. 15 is a cross-sectional view on line 15—15 of FIG. 14, in the direction of the arrows.
Figure 18:
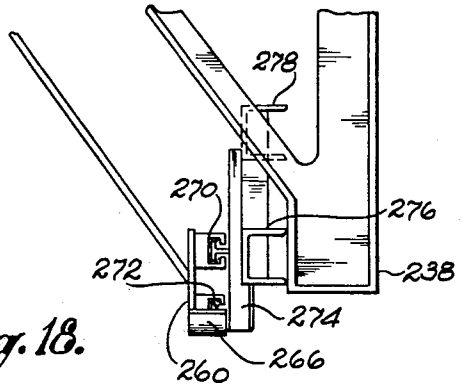
FIG. 18 is detail on line 18—18 of FIG. 17, in the direction of the arrows.

Referring additionally to FIGS. 14 and 15, the manner of location of the auger flights 242, 244, 246, 248 and 250 is more clearly illustrated. It will be seen that when concrete is fed into the hopper 240 it is distributed by the auger flights through conduits such as at 252, 254 and 256, to a combination consolidation and molding section, which can also be described as an extrusion die 258. The extrusion die 258 is formed with bottom die members 260, upper side walls 262 and a top wall 264. Referring additionally to FIG. 18, the bottom die member 260 is formed with a skid shoe 266 for riding laterally on the frame 238, as guided by ball races 270 and 272, thereby permitting lateral vibration. As shown in FIG. 18, but omitted for clarity in FIG. 13, the ball races are supported on a vertical member 274 which, in turn, is vertically slidable within ball races indicated at 276 and 278 attached to the frame 238. This arrangement allows the vertical extent of the median barrier to be varied in accordance with grading conditions so that the top of the barrier is maintained substantially uniform. Vertical movement of the bottom die 260 is guided by hydraulic means as hereinafter described.

Considering FIG. 13 in more detail, a plurality of pneumatic vibrating assemblies, shown schematically at 280, are positioned on the side walls 262 and the bottom die member 260 whereby to laterally vibrate these members with a high frequency as hereinbefore described. In addition to the ball races 270 and 272 described hereinabove with respect to the bottom die member 260, the side members 262 are carried on flanges 282 horizontally slidable within ball races such as at 284 affixed to the frame 238 (by means not shown). By such means, friction between the consolidated concrete mix and die walls is greatly reduced.

Figure 16:
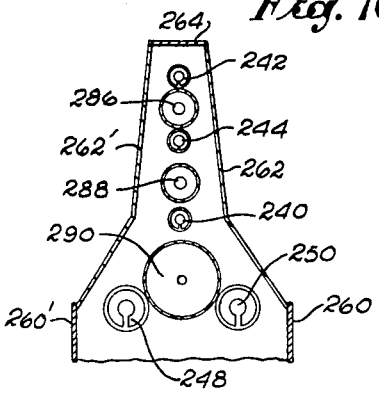
FIG. 16 is a cross-sectional view on line 16—16 of FIG. 14, in the direction of the arrows.

Referring additionally to FIGS. 14 and 16, three core forming mandrels 286, 288 and 290 are supported on high tensile steel bars 292, 294 and 296 respectively which, in turn, are connected to anchor beams 298 (FIG. 13) joisted between lateral frame members. Pneumatic vibrators 280 are connected to the bars 292, 294 and 296 to transmit high frequency vibration to the mandrels 286, 288 and 290. The augers are supported on drive shafts, such as 300 which are carried on bearing supports 302 joisted between lateral frame members 238, and driven by motors, indicated schematically at 304, carried by joisted support members 306. Carriage wheels (only one of which is shown at 308) are pivotally mounted in ball joints 310 carried on the sides of the frame 238 and are connected by hydraulic leveling and steering arms 312 and 314 respectively.

Figure 17:
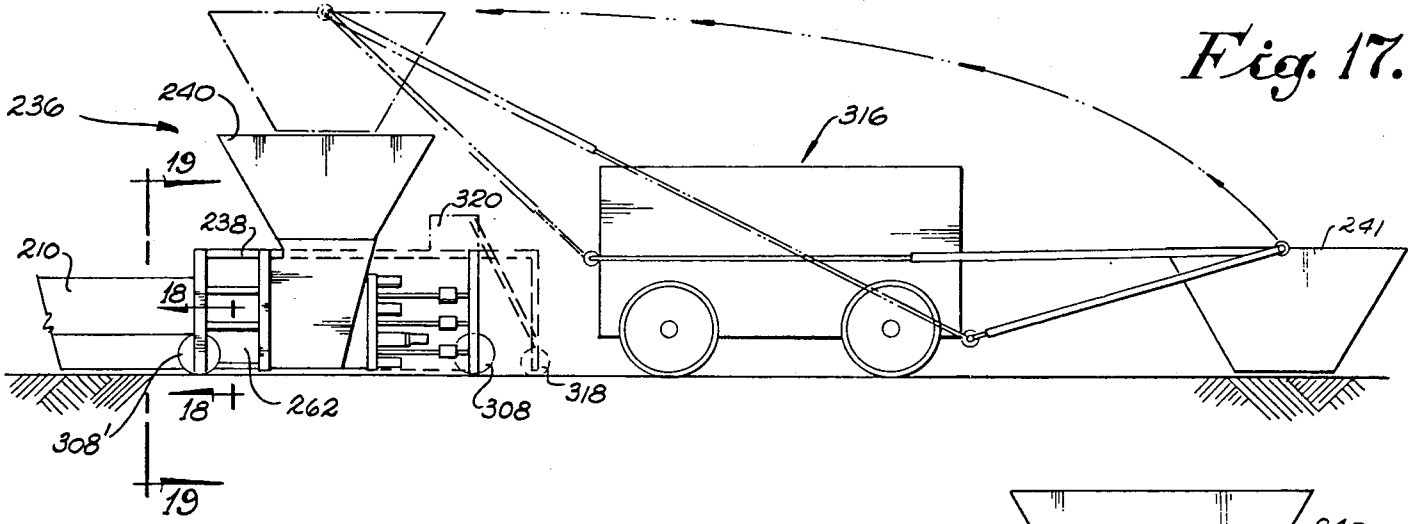
FIG. 17 is a diagrammatic longitudinal elevation of an extrusion train as utilized herein.
Figure 19:
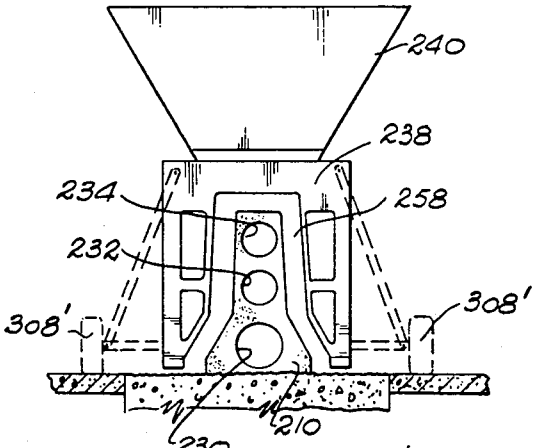
FIG. 19 is an elevational view on line 19—19 of FIG. 17, in the direction of the arrows.

Operation of the median barrier extruder 236 can be further explained with respect to FIGS. 17 and 19. "Dry" concrete mix of the "no-slump" type is delivered by a transit mixer to a hopper 241 whereupon the concrete mix is fed via articulated arms of power unit 316 to hopper 240 and thence to the augers flights 242, 244, 246, 248 and 250 to the extrusion die 262 and extruded as a concrete median barrier 210 thereby propelling the extruder 236 rearwardly. Grade is "read" by an offset wheel 318 which automatically records vertical displacement. Realignment and level "instructions" are transmitted to the hydraulic system via a compressed air system indicated schematically at 320, which records the rise, fall and change of direction of the guide wheel 318. The rear carriage wheels 308 are smoothly adjusted to the new alignments while the front carriage wheels 308' gradually follow, thereby assuring smooth transitions on the top surface of the barrier 210. Leveling is also automatically accomplished by similar hydraulic and pneumatic feedback. Crossfall is accommodated by the bottom forms 260, as previously described, moving vertically in relation to the remainder of the extrusion die 258. The result is a continuous, accurately laid median barrier 210 automatically extruded in place.

Referring now to FIGS. 20–23, and in particular to FIGS. 20 and 21, there is illustrated still another embodiment whereby prestressed, transversely reinforced concrete piles 322 can be produced. The extruder 324 includes a hopper 326 in communication with four auger flights 328, 330, 332 and 334. The auger flights extend through a conveyor section 336 which communicates with a combination consolidation and molding section, referred to hereinafter as an extrusion die section 338, including side walls (shown in shadow) at 340 and a top wall 342. A core-forming mandrel 344 is disposed axially central of the extrusion die 338, the lines of auger flights being disposed axially lateral of the mandrel 344 in quadrature relationship thereabout. The extruder 324 is movably carried on wheels as indicated by the dashed lines 346 and 348 so as to be propelled rearwardly by the extrusion operation.

In this embodiment, the conveyor section 336 extends within the extrusion die section 338 so that there is an overlap region, indicated in FIG. 20 at 350. Pre-tensioned cables 352, 354, 356 and 358 are disposed in the path of extrusion for longitudinal tensioning of the concrete pile 322. The overlap region is provided for insertion of U-shaped steel ties 360 as transverse reinforcement. During the extrusion operation the U-shaped ties are inserted into the concrete mix at the overlap region 350.

Referring to FIGS. 22 and 23, a mechanism is illustrated whereby the reinforcement ties 360 are carried through the overlap region 350 into consolidation with the concrete mix. Opposed sets of sprocket wheels 362, 362' and 364, and 364' are journaled across the overlap region and fitted with sprocket chains 366 and 366'. Cylindrical rods 372 and 374 (only two are illustrated for clarity) are carried between appropriately spaced links such as 368 and 368' and 370 and 370'. Each rod 372 and 374 laterally carries finger bars 376, 376' and 378, 378' which are formed at their outward ends with slots 380 for engaging and guiding the tie bars 360. The finger bars 376, 376' and 378, 378' are disposed through slots 382 in the side walls 340, coextensive with the overlap region 350. The sprocket wheels 362, 362' and 364, 364' are geared into one of the carriage wheels 346 or 348 whereby to move the fingers 376 and 378 through the slots 382, i.e., through the overlap region 350, at the extrusion speed so as to carry the tie bars 360 into consolidation with the concrete mix. At the end of the slots 382, the finger bars 376, 376' and 378, 378' encounter the wall 340. The rods 372 and 374 are rotatable within the links 368 and 370 but are formed with square top ends 384 and 386 which are rotatably fixed by insertion within a square opening 388, 390 (FIG. 22) in a lock bar 392 and 394 carried by the linkages 368 and 370. Each lock bar is pivotally carried at one end against a leaf spring 396 so as to release the finger support rod 372 when tripped. By way of example, as the finger bar 376 encounters the end of the slot 382, the lock bar 392 encounters a trip lug shown schematically at 398 whereupon it is pivoted against its spring 396 to release the rod 372, thereby enabling the finger bar 376 to clear the wall 340. As the finger bar 376 clears the wall 340, it is brought back to its extended position by means of a return spring 400.

If desired, in place of the tie rods, 360, one can insert fabric or mesh reinforcement through the overlap region, or can insert other reinforcement as desired. Various other additions, modifications and adaptations can be made. For example, imprint rollers such as depicted at 84 and 86 in FIGS. 4 and 5, can be utilized in wider form to imprint any architecturally desired pattern on the exterior surface of the extruded slab. Still other modifications will be apparent from the foregoing description.

I claim:

1. Apparatus for forming concrete articles, comprising:

a molding station including form surfaces;

walls defining a conveyor station including at least one auger for conveying concrete mix into said molding station, said auger having flights for extruding said mix;

at least one core forming mandrel disposed in said molding station and formed by walls having external surfaces in the path of extrusion from said auger flights;

said auger being rotationally independent from said mandrel;

said auger and said mandrel being relatively disposed so that the longitudinal axis of said auger is lateral of the longitudinal axis of said mandrel;

means associated with said conveyor station for introducing concrete mix to said auger;

means associated with said auger for rotating said auger to convey said mix to the form surfaces of said molding station with sufficient force to form and extrude a consolidated mix relative to said form surfaces;

means associated with said form surfaces for vibrating said form surfaces at a frequency greater than 22,000 vibrations per minute, while extruding said consolidated mix, to reduce friction between said form surfaces and said consolidated mix;

said form surfaces overlapping said conveyor station walls, and including means at the region of overlap of said form surfaces and said conveyor station walls for inserting reinforcement members into and transverse of said concrete mix and for moving said reinforcement members at extrusion speed through at least an initial region of said molding station for consolidation with said mix.

* * * * *